US006872019B2

(12) United States Patent
Schalk et al.

(10) Patent No.: US 6,872,019 B2
(45) Date of Patent: Mar. 29, 2005

(54) CARRIAGE ROD AND MEDIA SUPPORT

(75) Inventors: Wesley Ryan Schalk, Camas, WA (US); William T. Stephenson, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/409,769

(22) Filed: Apr. 9, 2003

(65) Prior Publication Data

US 2004/0202500 A1 Oct. 14, 2004

(51) Int. Cl.[7] ..... B41J 11/02
(52) U.S. Cl. ..... 400/656; 400/692
(58) Field of Search ..... 400/283, 320, 400/323, 648, 656, 659, 691, 692, 693

(56) References Cited

U.S. PATENT DOCUMENTS

| | | | | | |
|---|---|---|---|---|---|
| 4,609,294 | A | | 9/1986 | Gomoll et al. | |
| 4,723,857 | A | | 2/1988 | Yokoi | |
| 5,195,836 | A | * | 3/1993 | Longust et al. | 400/354 |
| 5,475,412 | A | * | 12/1995 | Wong | 347/104 |
| 5,874,979 | A | * | 2/1999 | Ohyama | 347/104 |
| 6,379,064 | B1 | * | 4/2002 | Giles et al. | 400/691 |
| 6,394,672 | B1 | * | 5/2002 | Murray et al. | 400/58 |
| 6,503,011 | B2 | * | 1/2003 | Kono | 400/646 |

* cited by examiner

*Primary Examiner*—Ren Yan

(57) ABSTRACT

A carriage rod and media support system in a printing mechanism comprises a platen including a carriage rod support and a print media support.

22 Claims, 3 Drawing Sheets

Fig. 1
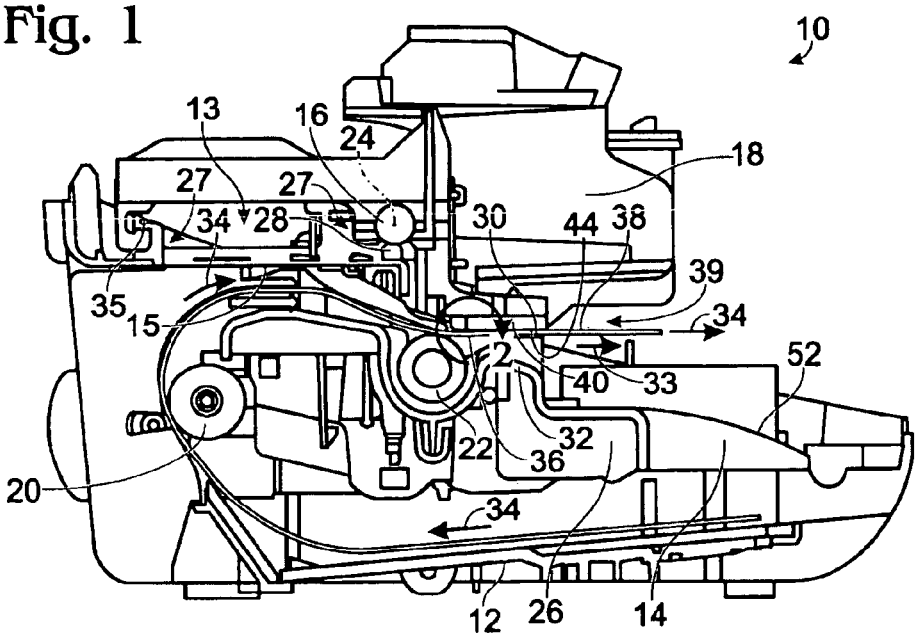
Fig. 2
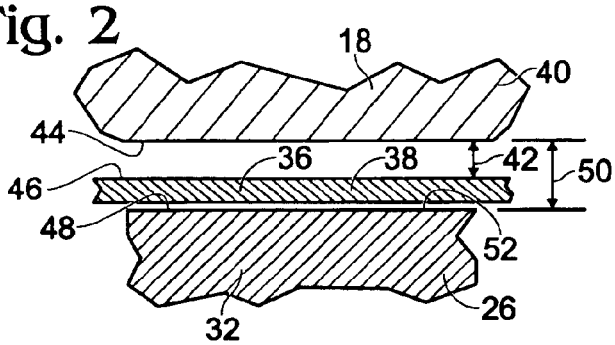
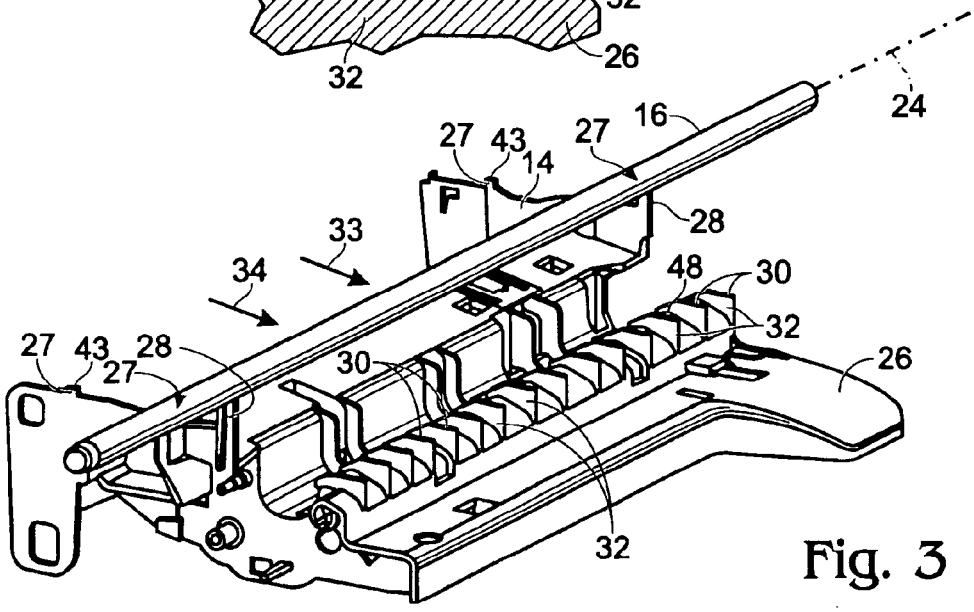
Fig. 3

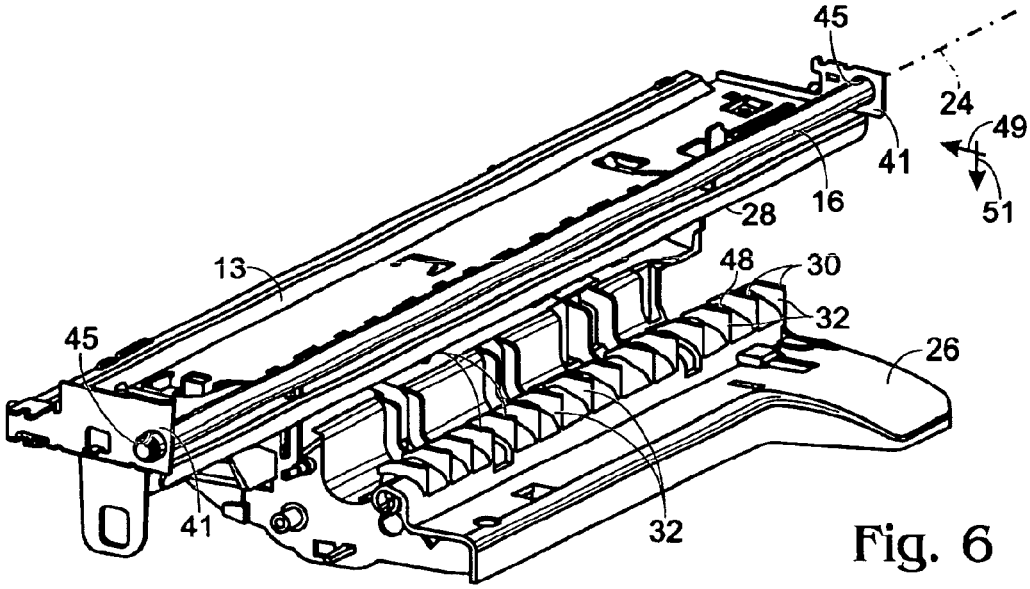
Fig. 6
Fig. 7
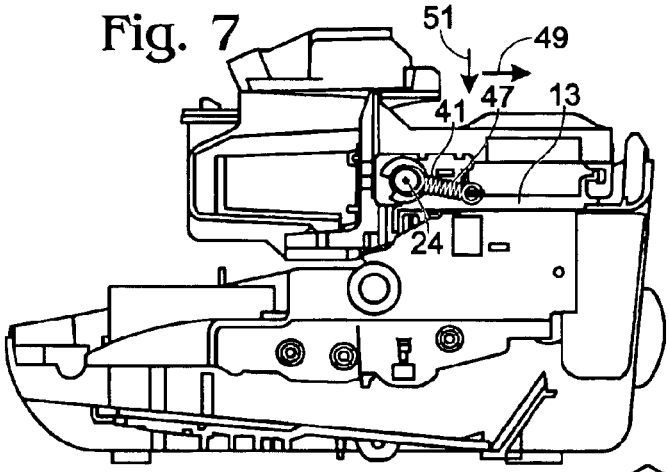
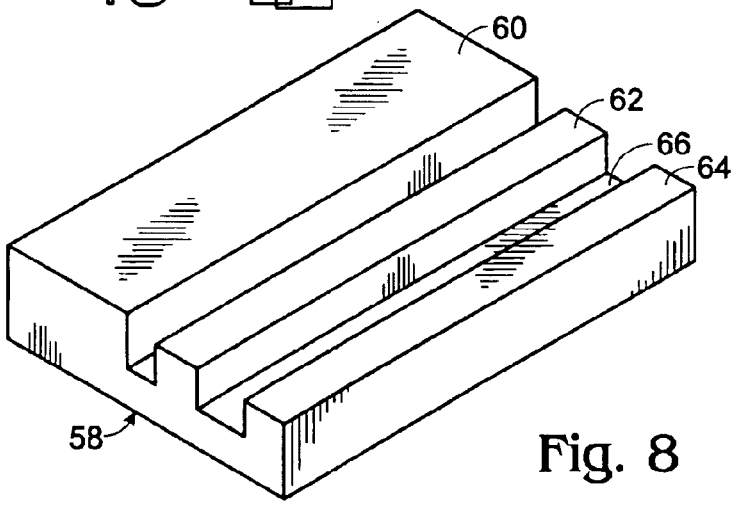
Fig. 8

CARRIAGE ROD AND MEDIA SUPPORT

BACKGROUND

Printing mechanisms, such as those used in desktop printers, use one or more print cartridges, sometimes referred to as "pens" which may shoot drops of liquid colorant, referred to generally herein as "ink," onto a page supported on a platen. Platens typically are used in printers and may include a support surface for supporting and/or guiding a sheet of print media through a print zone of the printing mechanism. Each print cartridge has a print head with very small nozzles through which the ink drops are fired. To print an image, the print head typically is propelled back and forth across the media page and fires drops of ink in a desired pattern on the page. The print cartridge is usually supported in a carriage that is generally moved back and forth along a carriage rod that is positioned perpendicular to the axis of media travel.

In such printers the distance between the surface that supports the media, such as ribs on a platen, and the print head may affect printing high quality images. In general, the closer the print head is to the media, the better the image quality the printer can produce. However, if the print head gets too close to the media there is a risk that the media could contact the print head, potentially resulting in smeared output and/or damage to the print head.

In many printers today, the carriage rod is supported directly on the printer base and the ribs that support the media are separately located on a platen which is also supported by the printer base. In such a device the print head-to-media support spacing generally has large tolerances, i.e., a large variation in spacing for similarly manufactured printers, so that print head-to-media support spacing and, therefore, print quality, is not consistent printer-to-printer. Moreover, no adjustment mechanisms are provided to adjust print head-to-media spacing.

In other printers, adjustment mechanisms may be positioned between the base and the carriage rod so that the print head-to-media spacing can be adjusted during the manufacturing process to provide tight spacing control. However, adjustment of the print head-to-media spacing is generally accomplished manually; leading to higher production costs due to increased part count and assembly time and could lead to human error in adjustment of the adjustment mechanisms. Adjustment mechanisms also pose a risk that the print head-to-media spacing could move during transportation or use of the printer.

SUMMARY

One embodiment of a carriage rod and media support system in a printing mechanism comprises a platen including a carriage rod support and a print media support.

BRIEF DESCRIPTION OF THE DRAWINGS

FIG. 1 is a side cross-sectional view of one form of a printer, here shown as an inkjet printer, having one form of the carriage rod and media support system according to an embodiment of the present invention.

FIG. 2 is a side, cross-sectional view of the print head-to-media spacing of the carriage rod and media support system of FIG. 1.

FIG. 3 is a perspective view of the carriage rod and media support system of FIG. 1 showing the carriage rod supported thereon.

FIG. 6 is a perspective view of the chassis of FIG. 5 secured to the platen of FIG. 4.

FIG. 7 is a side cross-sectional view, showing an opposite side from that shown in FIG. 1, of the carriage rod and media support system.

FIG. 8 is a perspective view of one embodiment of a mold designed for the manufacture of the carriage rod and media support system of FIG. 3.

DETAILED DESCRIPTION OF THE DRAWINGS

Figure 4:
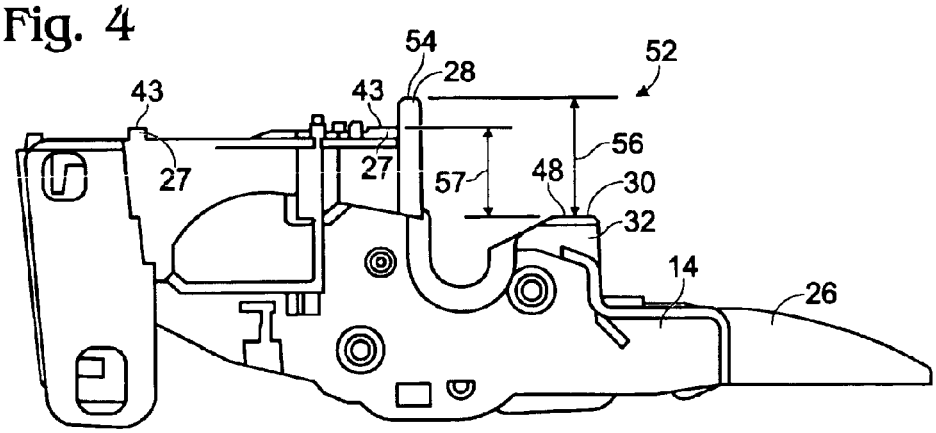
FIG. 4 is a side view of the carriage rod and media support system of FIG. 3 without the carriage rod supported thereon.

FIG. 1 illustrates one embodiment of a printing mechanism, here shown as an inkjet printer 10, which may include a base 12, a chassis 13, a carriage rod and media support system 14, a carriage rod 16, a carriage assembly 18, a drive roller 20 and a feed shaft 22. The printing mechanism of the present embodiment may be utilized for the printing for business reports, correspondence, desktop publishing, and the like, in an industrial, office, home or other environment. A variety of printing mechanisms are commercially available. For instance, some of the printing mechanisms that may include embodiments of the present invention include plotters, portable printing units, copiers, cameras, video printers, and facsimile machines, to name a few.

Base 12 typically is manufactured of a material that will support the recited printer components. In one embodiment, base 12 is manufactured of rigid plastic. In other embodiments base 12 may be manufactured of steel. Chassis 13 may be manufactured of steel to provide tight tolerances and structural strength. Carriage rod 16 may be manufactured of steel so as to provide a tight tolerance travel path for carriage assembly 18, which is moveably supported thereon. However, other materials may be utilized for the manufacture of chassis 13 and carriage rod 16.

Carriage rod 16 defines an elongate axis 24, shown extending into the page in this figure, wherein a print head 44, i.e., a nozzle surface of carriage assembly 18, moves back and forth on carriage rod 16 along axis 24. Carriage rod and media support system 14, in the embodiment shown, comprises a platen 26 including chassis support tabs 27 (see also FIG. 3), two carriage rod support posts 28 (only one of which is shown in FIG. 1) and a media support plane 30, also called a media support surface 30. In this embodiment, platen 26 may be manufactured of rigid plastic or the like. In the embodiment shown, media support plane 30 comprises the top surface 48 of a plurality of media support ribs 32 aligned in a row along a direction parallel to carriage rod axis 24, wherein each rib 32 extends parallel to a media travel direction 33 in a print zone 39, wherein media travel direction 33 is perpendicular to axis 24. In the embodiment shown, base 12 and platen 26 define a print media travel path 34 that extends below platen 26, around drive roller 20, over feed shaft 22 and through an area between ribs 32 on platen 26 and print head 44. As shown, the posts 28 and the tabs 27 are integrally formed as a single piece with the platen 26.

Chassis 13, also referred to as the "backbone" of the printing mechanism, may include a carriage rotation stop 35 to ensure that print head 44 does not rotate about carriage rod 16, carriage rod supports 41 for supporting carriage rod 16 in a horizontal orientation, wherein supports 41 may comprise slots or apertures 45 for receiving the rod therein, (see FIGS. 5 and 6), and a lower surface 15 (see FIG. 5) that is secured to chassis support surface 43, defined by the upper surface of each of tabs 27 on platen 26, so as to ensure platen 26 is fixedly secured to chassis 13 in a known location.

Referring now to FIG. 2, which is a cross-sectional view of the print head-to-media spacing of the carriage rod and media support system 14 of FIG. 1, during printing by printer 10 a section 36 of a page 38 of print media is positioned on top surface 48 of ribs 32 and below print head 44, also referred to as the nozzle surface, of print cartridges 40. The distance 42 between print head 44 of print cartridges 40 and an upper surface 46 of section 36 of page 38 is defined by the position of plane 30, which is defined by the top surface 48 of each of ribs 32, the thickness of page 38, and the position of print head 44 of print cartridges 40, wherein the position of print head 44 is defined by carriage rod support posts 28 of FIG. 1. For ease of illustration, FIG. 2 shows a small space, or gap, between a bottom surface of the page 30 and the top surface 48 of ribs 32. In operation, however, the bottom surface of the page 30 is typically supported at least in part by the top surface 48 of the ribs 32.

Chassis supports 27, also referred to as datum surfaces 27, on platen 26 and carriage rotation stop 35 of chassis 13 may further define the distance 42 between print head 44 and surface 46 of page 38. Accordingly, for print media having a standard thickness, the print head-to-media spacing 42 is defined by carriage rod support posts 28 and print media support plane 30, both of which are positioned on a single upper surface 52 of platen 26 in close proximity to each other. The chassis support surfaces 27 of the chassis 13 may further define the location of carriage rod 16 and therefore may also define spacing 42. In other words, a distance 50 from print head 44 to rib surface 48, also referred to as the print head-to-media support spacing and the print head-to-rib spacing 50, may be defined by chassis supports 27, carriage rod support posts 28 and print media support plane 30, all of which are positioned on a single upper surface 52 of platen 26 in close proximity to each other.

In particular, in the embodiment shown, the cooperation of parts is as follows. The print head 44 is part of print cartridge 40 which is supported by carriage assembly 18 which is supported by carriage rod 16 and oriented by carriage rotation stop 35 on chassis 13. Carriage rod 16 is supported in a vertical fashion by carriage rod support posts 28 and in a horizontal fashion by the carriage rod support slots 45 (FIG. 5) on chassis 13. Another embodiment (not shown) of the carriage rod support could eliminate carriage rod support 41 on chassis 13 by fastening carriage rod 16 directly to carriage rod support posts 28 on platen 26 to support carriage rod 16 in both vertical and horizontal fashions. Another embodiment (not shown) of the carriage rotation stop 35 may include replacing the rotation stop 35 on chassis 13 with a similar feature located on platen 26. Rib surface 48 on ribs 32 on platen 26 is located by chassis support 27 on chassis 13 in both the vertical and horizontal directions. Carriage rod support posts 28 are also tightly controlled to chassis support 27 and rib surface 48 on ribs 32 on platen 26 in the vertical and horizontal directions.

Referring now to FIGS. 1 and 2, manufacturing of platen 26, including chassis support tabs 27, carriage rod support posts 28 and ribs 32, to specific tolerances, so as to provide a predetermined and desired print head-to-rib spacing 50, is a relatively easy manufacturing task because chassis support 27, posts 28 and ribs 32 are all positioned on the same side of platen 26. Accordingly, chassis support 27, posts 28 and ribs 32 are all positioned on the same side of a mold that may be used for injection molding of platen 26. In one embodiment the mold is manufactured of steel and the platen is manufactured of rigid plastic. By positioning chassis support 27, posts 28 and ribs 32 on the same side of platen 26, minimizing the tolerance between print head-to-media 42 is achieved, without requiring adjustment of the carriage rod position relative to rib surface 48 on ribs 32.

A method of producing carriage rod and media support system 14 and, therefore, a method of reducing print head-to-media spacing variation in a printer, will now be described. First, platen 26 is manufactured. In one embodiment, a mold (shown in FIG. 8) is provided wherein chassis support 27, carriage rod support posts 28 and a media support surface 30 are all formed on the same side of the mold in close proximity to each other. Because chassis support 27, supports 28 and surface 30 are all provided on the same side of the mold in close proximity to each other, the mold can be manufactured to produce these structural elements with high precision, i.e., with tight tolerances. The platen is then injection molded, in the embodiment shown, by providing a liquid material to the mold. After hardening of the part within the mold, the part is ejected from the mold to provide a platen 26, also called a support structure, having chassis support 27, carriage rod support 28 and media support 30 all positioned thereon. The platen may then be installed onto chassis 13 by fasteners 53 (FIG. 5) positioned between chassis supports 27, also referred to as chassis mounting pads 27, in a printer 10. The carriage rod 16 may be secured to carriage rod supports 28 and carriage assembly 18 may be movably secured on the carriage rod. A print media travel path 34 may be provided, such as defined by drive roller 20 and feed shaft 22, that typically extends between carriage rod 16 and media support surface 30. The chassis support 27, carriage rod supports 28 and the media support surface 30 are each manufactured on platen 26 so as to define a desired and predetermined print head-to-media spacing 42 between a sheet of print media 38 supported on surface 30 and print head 44 of print cartridges 40 of carriage assembly 18. Thus, a method of reducing print head-to-media spacing variation 42 in a printer is described.

FIG. 3 is a perspective view of one embodiment of the carriage rod and media support system 14 of the present invention showing the carriage rod 16 supported on posts 28 of platen 26. Chassis support 27, such as extension tabs 27, are shown on the top surface of platen 26 (see FIG. 4). In FIG. 3, two of extension tabs 27 are shown in a rearward portion of the platen and two of extension tabs 27 are positioned on a forward portion of the platen and are hidden from view by carriage rod 16. Ribs 32 are shown extending in a row parallel to carriage rod axis 24, wherein each rib may extend parallel to print media travel direction 33. The top surface 48 of each of ribs 32 may define media support surface 30. In other embodiments, media support surface 30 may comprise other shapes and or structural elements so as to support a print media as it travels along media travel path 34. Those skilled in the art will understand that print media 38 (FIG. 1) may comprise an elongate sheet of material, a discrete sheet of material, or other size or shape of material utilized for a particular application. Moreover, print media 38 may comprise paper, fabric, card stock, photographic paper, a transparency, or the like.

FIG. 4 is a side view of the carriage rod support system 14 of FIG. 3 wherein carriage rod 16 is not shown secured to platen 26. A top surface 54 of carriage rod support posts 28 is positioned a distance 56, which is a vertical distance in the embodiment shown, above support surface 30 which is defined by the top surface 48 of ribs 32. Top surface 43 of chassis support 27 is positioned a distance 57, which is a vertical distance in the embodiment shown, above support surface 30 which is defined by the top surface 48 of ribs 32.

Distances 56 and 57 are chosen so that when carriage assembly 18 is secured to rod 16, print head 44 (FIG. 2) of print cartridge 40 will be positioned a predetermined print head-to-print media distance 42 (FIG. 2) from a top surface of section 36 of sheet of print media 38 (FIG. 2) and a predetermined print head-to-print media support distance 50 from top surface 48 of ribs 32. Accordingly, in printers designed to print on sheets of paper, the thickness of a standard sheet of paper may be used to determine the height of top surface 54 of posts 28 from the plane 30 that includes the top surface 48 of each of ribs 32. Similarly, in printers designed to print on card stock, the thickness of a standard sheet of card stock may be used to determine the height of top surface 54 of posts 28 from the plane 30 that includes the top surface 48 of each of ribs 32.

Figure 5:
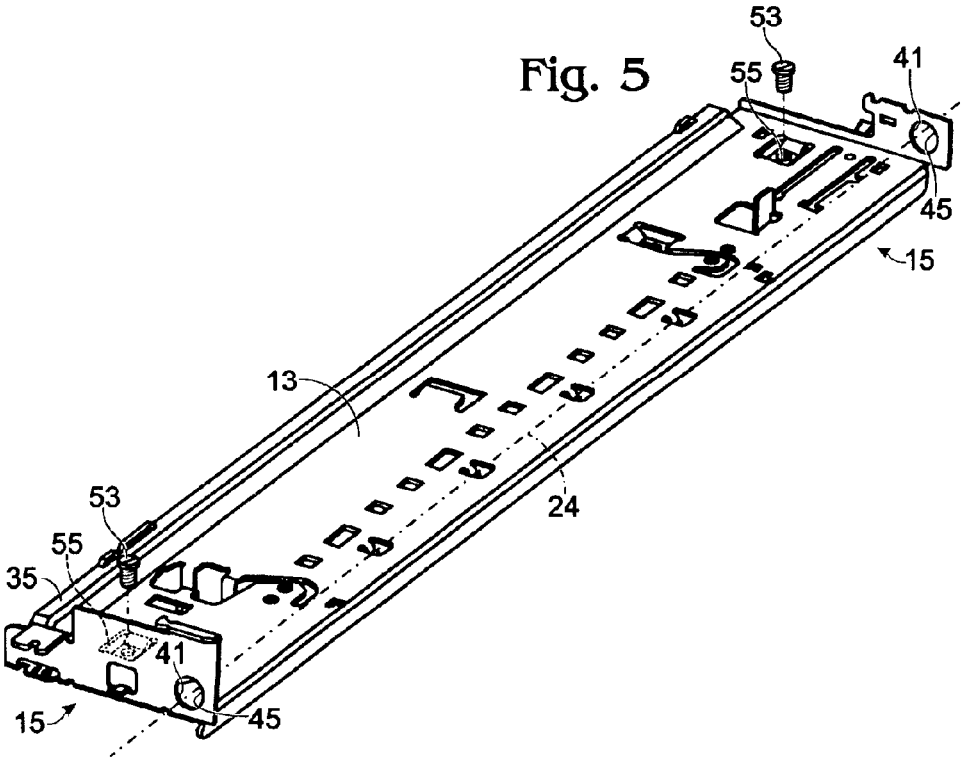
FIG. 5 is a perspective view of one embodiment of a chassis of the media support system of FIG. 1.

FIG. 5 is a perspective view of one embodiment of chassis 13 of the media support system of FIG. 1. Chassis 13 includes rotation stop 35 that defines the stop point of rotation of carriage assembly 18 about carriage rod 16, with respect to platen 26. In a preferred embodiment, rotation stop 35 ensures that no rotation of carriage 18 takes place about carriage rod 16. Chassis 13 also includes carriage rod support slots 45 for receiving carriage rod 16 therein. Slots 45 define the horizontal location, i.e., the location along carriage rod elongate axis 24, of carriage rod 16. In the embodiment shown, platen 26 is secured to chassis 13 by two fasteners 53 that extend through apertures 55 in the chassis and are secured within corresponding apertures in platen 26, between platen support tabs 27 (FIG. 4). Backbone, or chassis, 13 may include other components of the printing mechanism secured thereto, wherein such other components are not shown in this view and are not a part of the present invention. Accordingly, chassis 13 in the illustrated embodiment serves one or more of the following three functions: locating platen 26 within the printing mechanism, i.e., platen 26 is secured to the chassis 13 at extensions 27 of the platen; defining a rotation stop for carriage 18; and defining the horizontal location of carriage rod 16 along axis 24.

FIG. 6 is a perspective view of the chassis of FIG. 5 mounted on the platen of FIG. 4. Chassis 13 is shown mounted on platen 26 such that the position of the chassis with respect to the platen is defined in both the horizontal and vertical dimensions by support surfaces 43 of chassis supports 27, located on platen 26. Carriage rod 16 is shown extending through slots 45. In the embodiment shown, the top surface 54 (See FIG. 4) of support posts 28 are flat such that rod 16 is positioned on flat surfaces 54. Rod 16 may be constrained against movement in the horizontal direction by slots 45 of chassis 13 and may be constrained against movement in the vertical direction by the biasing force of spring 47 (see FIG. 7). In another embodiment (not shown) the top surface 54 of the support posts 28 may be slightly curved such that rod 16 may be seated on the curved top surface 54 wherein the curved surface may constrain the rod 16 against movement in the horizontal direction. In another embodiment (not shown) the top surface 54 of the support posts 28 may include an aperture for receiving a fastener, such as a screw, that is secured through a mating aperture in rod 16 to secure the rod to posts 28.

FIG. 7 is side cross sectional view of one form of printer 10, showing an opposite side from the view shown in FIG. 1, having one form of the carriage rod and media support system of the present invention. Rod 16 is shown installed on support posts 28 of the platen and through apertures 41 of chassis 13. A biasing element 47, such as a spring 47, biases rod 16 in a rearwardly direction 49 and in a downwardly direction 51 with respect to chassis 13, onto the top surface of support posts 28 of platen 26. Accordingly, chassis 13 and support posts 28 of platen 26 together define the location of carriage rod 16 within the printing mechanism in some embodiments.

FIG. 8 shows one embodiment of mold 58 designed for manufacturing platen 26. Mold 58 includes protrusions 60, 62 and 64 for the formation of chassis support 27, carriage rod support posts 28 and print media support 30, respectively. The outside of mold 58 is shown such that chassis support 27, posts 28 and support surface 30 will be formed by the under surface of the mold. In this embodiment, protrusions 60, 62 and 64 are all positioned on the same side 66 of mold 58 so that supports 27, 28 and 30 can be manufactured with great precision. Mold 58 typically is manufactured of steel but other materials may be utilized for the manufacture of mold 58.

The illustrated embodiment of FIGS. 1–8 is shown to illustrate the principles and concepts of the invention as set forth in the claims below, and a variety of modifications and variations may be employed in various implementations while still falling within the scope of the claims below.

We claim:

1. A carriage rod and media support system in a printing mechanism, comprising:

a platen manufactured as a single structure and including a carriage rod support and a print media support, wherein the carriage rod support and the print media support are not separable components of the platen.

2. A carriage rod and media support system according to claim 1 wherein said carriage rod support and said print media support are each positioned on a same side of said platen.

3. A carriage rod and media support system according to claim 2 wherein said platen includes a chassis support structure for securing a chassis thereto, wherein said chassis support structure is positioned on said same side of said platen.

4. A carriage rod and media support system according to claim 1 wherein a support surface of said carriage rod support and a support surface of said print media support are positioned a predetermined vertical distance from one another so as to define a predetermined print head-to-media spacing.

5. A carriage rod and media support system according to claim 1 further comprising a chassis, wherein said platen is secured to said chassis.

6. A carriage rod and media support system according to claim 1 further comprising a carriage rod mounted on said carriage rod support and a carriage assembly movably mounted on said carriage rod.

7. A carriage rod and media support system according to claim 1 wherein said carriage rod support comprises first and second posts spaced from one another.

8. A carriage rod and media support system according to claim 1 wherein said print media support comprises a plurality of ribs.

9. A carriage rod and media support system according to claim 8 further comprising a carriage rod axis and a print media travel axis positioned perpendicular to said carriage rod axis, wherein said plurality of ribs extend in a row parallel to said carriage rod axis and wherein said ribs each extend parallel to said print media travel axis.

10. A printer, comprising:

a chassis; and a platen secured to said chassis, said platen manufactured as a single structure and including a chassis support, a carriage rod support and a print media support, wherein the chassis support, the carriage rod support and the print media support are not separable components of the platen.

11. A printer according to claim 10 wherein said chassis support, said carriage rod support and said print media support are all positioned on a same side of said platen.

12. A printer according to claim 10 further comprising a carriage rod mounted on said carriage rod support, and a carriage assembly mounted on said carriage rod wherein a print head of said carriage assembly is positioned a predetermined distance from a support surface of said print media support.

13. A printer, comprising: a chassis; a platen secured to said chassis, said platen including a chassis support, a carriage rod support, and a print media support; a carriage rotation stop surface positioned on said chassis; a feed shaft extending through said platen; and a drive roller that defines a print media travel path around said platen.

14. A printer comprising:

a chassis;

a platen secured to said chassis, said platen defining a print zone and including an upper surface having a plurality of chassis support tabs, a plurality of carriage rod support posts and a plurality of print media support ribs extending upwardly there from, wherein said chassis support tabs, said carriage rod support posts and said print media support ribs are manufactured on said platen as one integral structural unit;

a carriage rod mounted on said carriage rod support posts and defining a carriage rod axis positioned perpendicular to a print media travel axis that extends through said print zone; and a carriage assembly mounted on said carriage rod, wherein said carriage assembly includes a print head positioned a predetermined distance from said media support ribs in said print zone.

15. A carriage rod and media support system in a printing mechanism, comprising:

a platen manufactured as a single structure and including means for supporting a carriage rod and means for supporting a print media, wherein the means for supporting a carriage rod and the means for supporting a print media are not separable components of the platen.

16. A carriage rod and media support system in a printing mechanism, comprising:

a platen manufactured as a single structural unit and including a carriage rod support and a print media support, wherein the carriage rod support and the print media support are not separable components of the platen.

17. A carriage rod and media support system according to claim 16 wherein said carriage rod support and said print media support are each positioned on a same side of said platen.

18. A carriage rod and media support system according to claim 16 wherein a support surface of said carriage rod support and a support surface of said print media support are positioned a predetermined vertical distance from one another so as to define a predetermined print head-to-media spacing.

19. A carriage rod and media support system according to claim 16 further comprising a carriage rod mounted on said carriage rod support and a carriage assembly movably mounted on said carriage rod.

20. A carriage rod and media support system according to claim 16 wherein said carriage rod support comprises first and second posts spaced from one another.

21. A carriage rod and media support system according to claim 16 wherein said print media support comprises a plurality of ribs.

22. A carriage rod and media support system according to claim 21 further comprising a carriage rod axis and a print media travel axis positioned perpendicular to said carriage rod axis, wherein said plurality of ribs extend in a row parallel to said carriage rod axis and wherein said ribs each extend parallel to said print media travel axis.

* * * * *